United States Patent [19]

Coxe et al.

[11] 3,963,195

[45] June 15, 1976

[54] ROLL REFERENCE SYSTEM FOR VEHICLES UTILIZING OPTICAL BEAM CONTROL

[75] Inventors: Frank S. Coxe, Santa Ana; Lyle A. Maxey, Dana Point; David P. Wahl, Whittier, all of Calif.

[73] Assignee: Northrop Corporation, Los Angeles, Calif.

[22] Filed: Jan. 27, 1975

[21] Appl. No.: 544,640

[52] U.S. Cl. ..... 244/3.11; 244/3.15

[51] Int. Cl.[2] ..... F41G 7/00

[58] Field of Search ..... 244/3.11, 3.13, 3.15; 250/203 R

[56] References Cited

UNITED STATES PATENTS

| | | | |
|---|---|---|---|
| 3,470,377 | 9/1969 | LeFebre et al. | 250/203 R |
| 3,746,280 | 7/1973 | Coxe et al. | 244/3.13 |

*Primary Examiner*—Samuel Feinberg
*Attorney, Agent, or Firm*—Edward A. Sokolski

[57] ABSTRACT

Control information for guiding of vehicles such as a missile, projectile or manned vehicle, is carried on an optical beam directed at such vehicle from a ground station. Information for roll stabilization of such vehicle is carried in such beam in the form of a polarized light wave. A polarizing beam splitter which is aligned with the vertical axis of the vehicle and carried thereon receives the beam and provides light outputs from one face thereof which is in accordance with the cosine squared of the angle between the vertical axis of the vehicle (or any other predetermined reference angle thereof) and the polarization angle of the light beam, and from an orthogonal face thereof which is in accordance with the sine squared of this same angle. The light emitted from each of the beam splitter surfaces is transduced to electrical form by means of light detectors and these electrical signals appropriately amplified for use in controlling a roll stabilization system.

6 Claims, 5 Drawing Figures

ROLL REFERENCE SYSTEM FOR VEHICLES UTILIZING OPTICAL BEAM CONTROL

This invention relates to vehicle roll stabilization systems, and more particularly to such a system utilizing a polarized light wave in conjunction with a polarizing beam splitter in providing information as to the roll angle of the vehicle.

Systems for stabilizing the roll of an airborne vehicle, such as a missile, projectile or manned vehicle, generally utilize gyroscopes in their implementation. In situations where the vehicle or projectile is subjected to very high accelerations, particularly in the case of projectiles shot from guns, such gyroscopic devices are subject to failure or have such stringent design requirements as to make for difficult and costly construction. Such gyroscopic devices further have power requirements for their rotors, which requirement is often difficult of attainment in relatively small projectiles which must obtain all their operating power from a battery. In addition, roll gyros are relatively costly instruments, particularly for use in gun projectiles.

Passive projectile and missile systems have been developed which receive all their control and guidance information from a control station, such information being carried on a light beam. The present invention is directed to a vehicle roll stabilization system for use in situations where such a light beam control is utilized, such as the system described in U.S. Pat. No. 3,746,280 issued July 17, 1973 and assigned to Northrop Corporation, the assignee of the present application. The present system obviates the use of gyros and utilizes components which are capable of withstanding high accelerations without a tendency to failure. Further, the system of this invention lends itself to economical construction and has minimal power requirements as compared with gyroscopic systems of the prior art.

It is therefore an object of this invention to provide a roll stabilization system capable of withstanding high shock and acceleration.

It is a further object of this invention to provide a vehicle roll stabilization system of simpler and more economical construction than prior art systems.

It is still another object of this invention to provide an improved vehicle roll stabilization system suitable for use in situations where an optical beam is employed to carry the control signals.

Other objects of this invention will become apparent as the description proceeds in connection with the accompanying drawings, of which:

Figure 1:
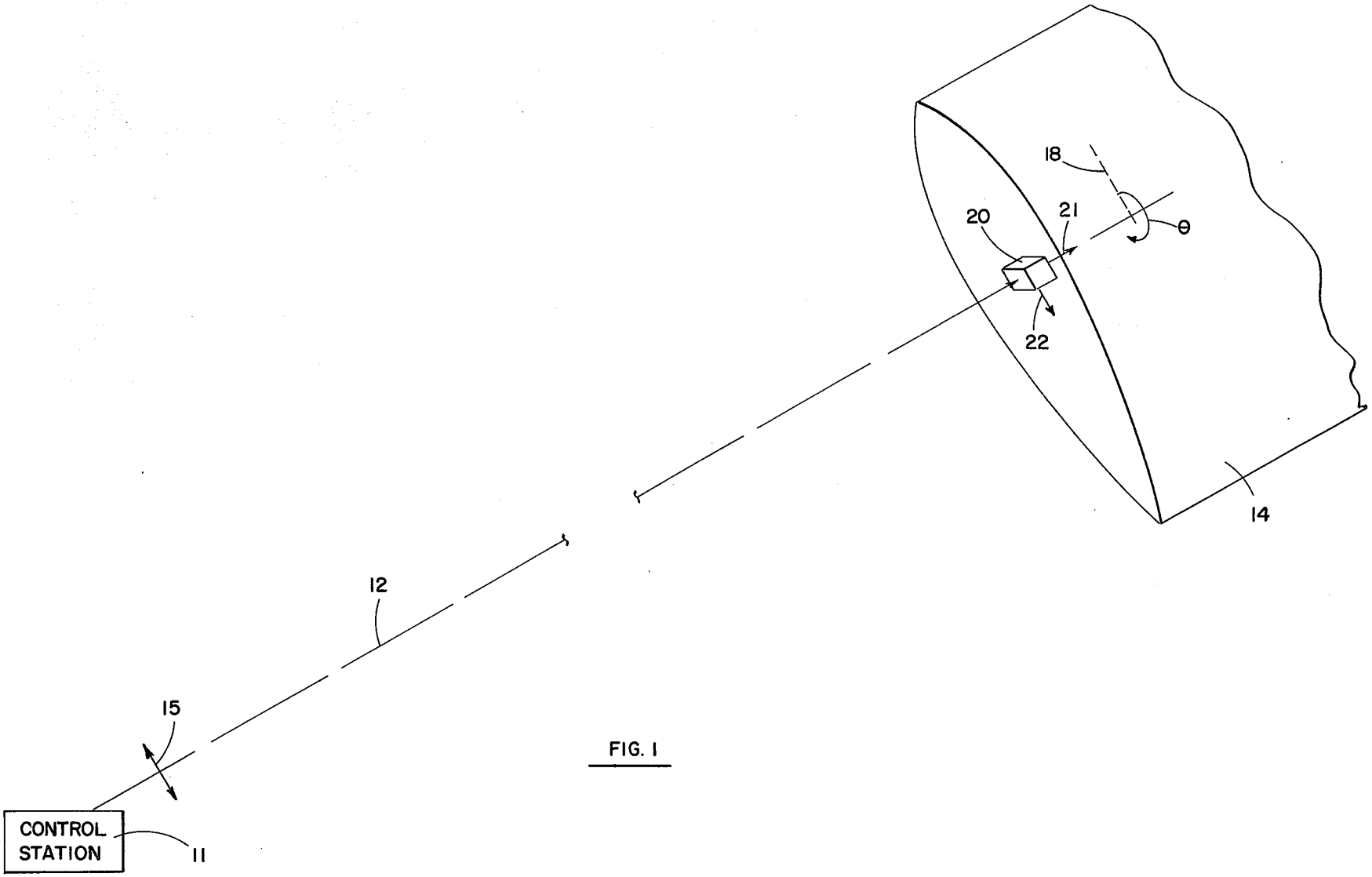
FIG. 1 is a schematic drawing illustrating the basic features of the invention.

Referring now to FIG. 1, the basic operation of the system of the invention is illustrated. A light beam 12 which carries control signals for controlling the flight path of vehicle 14 is transmitted from control station 11. Carried on this light beam are light waves having a predetermined polarization as indicated by arrows 15. Fixedly positioned on vehicle 14 is polarizing beam splitter 20 which may comprise a polarizing beam splitter cube. For the purposes of illustration, the cube is shown aligned with the vertical axis 18 of the missile. Polarizing beam splitter 20 splits light beam 12 into two components 21 and 22. The magnitudes of these components are dependent upon the orientation of the beam splitter about the axis of beam 12 (and thus the roll angle of vehicle 14 about this axis), this angle being indicated in the figure by "$\theta$". It is to be noted that while in the example of FIG. 1 the polarization 15 has been shown to be substantially vertical, that other polarization angles can be utilized as long as this angle is properly related to the polarizing beam splitter 20 in the missile to provide a desired orientation of the missile about the roll axis. Beam splitter 20 may be a conventional prism polarizer, such as a polarizing beam splitter cube commercially available from Broomer Research Corp., Plainview, N.Y.

It is well known (Malus' law) that the following relationship exists:

$$L_o = KL_i \cos^2\theta \qquad (1)$$

where $L_o$ is the light output 21 of beam splitter 20, $L_i$ is the light input 12 to the beam splitter, and $\theta$ is the angle between the polarization angle of light wave 15 and the angle of orientation of the side faces of the beam splitter relative to the angle of polarization of the polarized light. K is a constant of proportionality including the efficiency of the cube. It can also be shown that the light output 22 through the indicated face of the splitter normal to that from which light beam 21 is emitted varies as a function of $\sin^2\theta$ times the input light wave.

Figure 2:
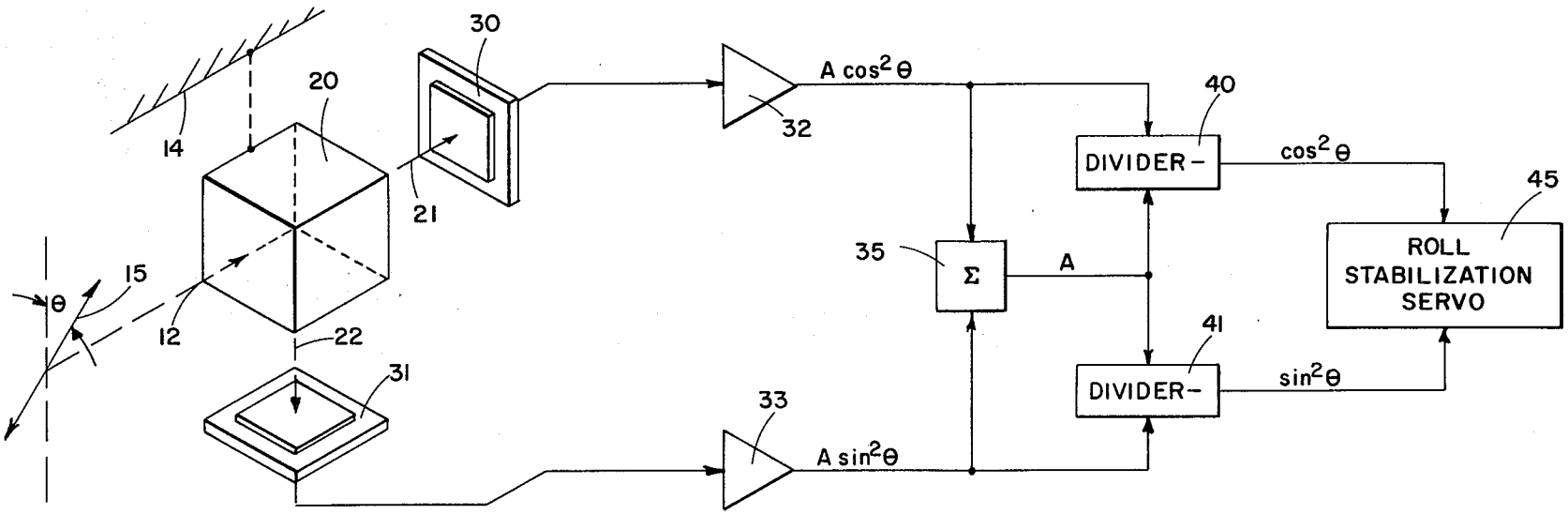
FIG. 2 is a schematic drawing illustrating a preferred embodiment of the invention.
Figure 3C:
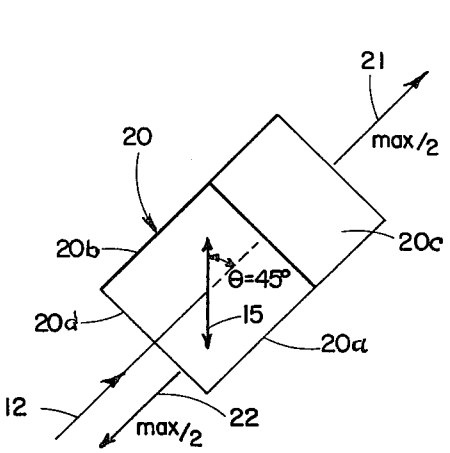
FIGS. 3A–3C are schematic drawings illustrating the operation of the system of the invention.
Figure 3B:
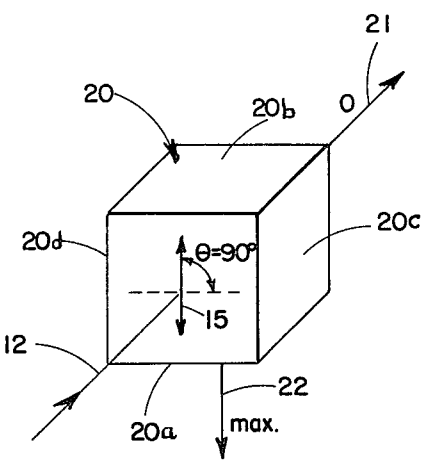
Figure 3A:
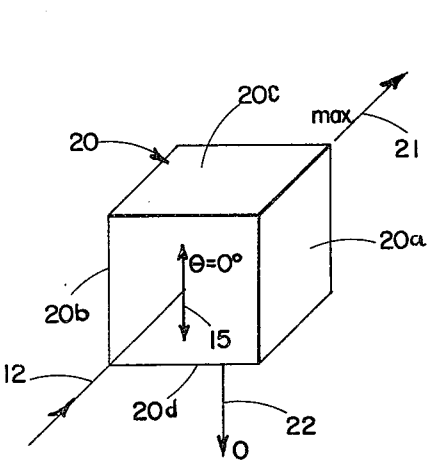

Referring now to FIGS. 3A–3C, various orientations of the light splitter relative to the polarization of the input light wave are illustrated. As shown in FIG. 3A, the side faces 20*a* and 20*b* of beam splitter cube 20 are oriented parallel to the polarization 15 of the polarized input light wave. In such a case (with angle $\theta$ equal to zero), beam 21 has a maximum output, while beam 22 has a minimum or zero output. FIG. 3B illustrates the situation where the polarization is normal to the side faces 20*a* and 20*b* of beam splitter 20, making for an angle $\theta$ therebetween of 90°. In such instance, beam 22 is at a maximum amplitude and beam 21 is at a minimum, or zero. Finally, FIG. 3C illustrates the situation where $\theta$ equals 45°, i.e., polarization 15 is at a 45° angle relative to side faces 20*a* and 20*b* (and side faces 20*c* and 20*d*) of the beam splitter. In such instance, the output beams 21 and 22 are equal in magnitude (max/2). It is to be noted that beams 21 and 22 will include non-polarized components present in beam 12, which will provide equal intensity components of output beams 21 and 22. These components, as to be explained in connection with FIG. 2, are eliminated in the processing circuitry so that only components due to the polarized light inputs remain.

Referring now to FIG. 2, a preferred embodiment of the invention is schematically illustrated. Light beam 12 having a polarized component with a polarization as indicated by arrows 15 enters polarizing beam splitting cube 20, which splits the beam into two components, 21 and 22, which components are transmitted through the face of the cube opposite to that through which beam 12 enters and a bottom face orthogonal to both of the aforementioned faces. Beam splitting cube 20 is fixedly attached to the structure 14 of a vehicle on which it is carried. Beam 21 strikes light detector 30 which provides an electrical output to amplifier 32 in accordance with the intensity of light beam 21. In similar fashion, beam 22 is detected by light detector 31 which provides an electrical output signal to amplifier 33. Amplifiers 32 and 33 are identical in their amplification characteristics and provide outputs A $\cos^2\theta$ and A $\sin^2\theta$ respectively, A representing light signals in the input beam 12 other than the polarized light signal of interest, these signals being common to both output beams 21 and 22 for all $\theta$ angles. The outputs of amplifiers 32 and 33 are summed in summing circuit 35 to produce as the output of the summing device a signal representing A. This output results in view of the fact that $A \cos^2\theta + A \sin^2\theta = A(\sin^2\theta + \cos^2\theta)$. As $\sin^2\theta + \cos^2\theta = 1$, the net result of the summation is the output A.

The output A $\cos^2\theta$ is fed from amplifier 32 to divider 40, while the output signal, A $\sin^2\theta$, is fed from amplifier 33 to divider 41. The output A of summing device 35 is fed to dividers 40 and 41 as the divisor therefor. Thus, the output of divider 40 is $\cos^2\theta$, while the output of divider 41 is $\sin^2\theta$, the signal A which represents the light components common to both components having been eliminated. The outputs of dividers 40 and 41 are fed to the vehicle roll stabilization servo 45 as a control signal for stabilizing the vehicle about the foll axis. It is to be noted that with a "tight" servo loop that the angle "$\theta$" will always remain relatively small in view of the response of the stabilization system in maintaining the vehicle at a preselected roll orientation.

The system of this invention thus provides simple and economical means for providing roll stabilization information for stabilizing the flight of an airborne vehicle in situations where the control signals for the vehicle are carried on a light beam.

While the invention has been described and illustrated in detail, it is to be clearly understood that this is intended by way of illustration and example only and is not to be taken by way of limitation, the spirit and scope of this invention being limited only by the terms of the following claims.

We claim:

1. In a control system for a vehicle, said system including a control station for transmitting an optical beam for carrying the control information, said beam having polarized waves, means for generating a roll stabilization signal for said vehicle comprising:

polarizing beam splitter means fixedly mounted on said vehicle for receiving said optical beam and providing at least one light output as a function of the angle between the polarization angle of said light waves and the plane of a predetermined side face of said beam splitter means, means for transducing said light output to a first electrical signal, means for amplifying said electrical signal, means for generating a second electrical signal in accordance with the non-polarized components of the optical beam, and means for dividing said first electrical signal by said second electrical signal thereby eliminating electrical components representing non-polarized optical components in said first electrical signal, the output of said dividing means being in accordance with the deviation of the roll angle of said vehicle from a predetermined orientation.

2. The system of claim 1 wherein said beam splitter means comprises a beam splitter cube.

3. The system of claim 1 wherein said beam splitter means provides first and second light outputs in accordance with the $\cos^2$ and $\sin^2$ respectively of said angle between the polarizing angle and the plane of said predetermined side face.

4. The system of claim 3 wherein said means for generating said second electrical signal comprises means for summing said first and second light outputs.

5. A system for providing a signal for stabilizing an airborne vehicle about its roll axis comprising:

control station means located on the ground for generating a light beam having light waves with a predetermined fixed polarization, polarizing beam splitter means fixedly mounted on said vehicle for receiving said beam and splitting said light waves into first and second components having amplitudes in accordance with the cosine squared and the sine squared respectively of the angle between the polarization angle of said light waves and the orientation of said beam splitter means about said vehicle roll axis, means for receiving said first and second light wave components and transducing said components into first and second electrical signals, means for amplifying said first and second electrical signals, means for summing said first and second electrical signals to provide a third signal in accordance with the non-polarized components of the light beam, means for dividing said first and second electrical signals by said third signal thereby eliminating components in said first and second signals representing non-polarized components of the beam, and a roll stabilization servo on said vehicle, the output of said dividing means being in accordance with the roll angle of the vehicle and being fed to said servo as a control signal therefor.

6. The system of claim 5 wherein said beam splitter means comprises a beam splitter cube.

* * * * *